United States Patent [19]

Ito et al.

[11] Patent Number: 4,469,243

[45] Date of Patent: Sep. 4, 1984

[54] COMBINATION CARTON AND SHIPPING PACKAGE, DISPENSING SYSTEM THEREFOR

[75] Inventors: John M. Ito, Cheltenham, Canada; James D. Cotton, Livonia, Mich.

[73] Assignee: Kimberly-Clark Corporation, Neenah, Wis.

[21] Appl. No.: 363,985

[22] Filed: Mar. 31, 1982

[51] Int. Cl.[3] ..... B65H 1/04

[52] U.S. Cl. ..... 221/34; 221/63

[58] Field of Search ..... 221/63, 34, 35, 56–60; 225/106; 312/39

[56] References Cited

U.S. PATENT DOCUMENTS

| | | | |
|---|---|---|---|
| 1,878,399 | 9/1932 | Hope | 225/106 |
| 3,161,336 | 12/1964 | Loescher | 225/106 |
| 3,446,395 | 5/1969 | Ballin | 221/63 |
| 3,459,329 | 8/1969 | Mochizuki et al. | 221/34 |
| 3,795,355 | 3/1974 | Gerstein | 225/106 |

*Primary Examiner*—Stanley H. Tollberg

*Attorney, Agent, or Firm*—Wendell K. Fredericks; Howard Olevsky

[57] ABSTRACT

Methods and systems for dispensing a plurality of serially connected separable wipers stacked in a carton is disclosed. Wiper folding techniques and carton dispensing port designs are employed to effect detaching a leading wiper from a trailing wiper in a manner enabling the trailing separable wiper to protrude through the port in a "pop-out" fashion, poised in a state of readiness as the next wiper to be dispensed.

15 Claims, 13 Drawing Figures

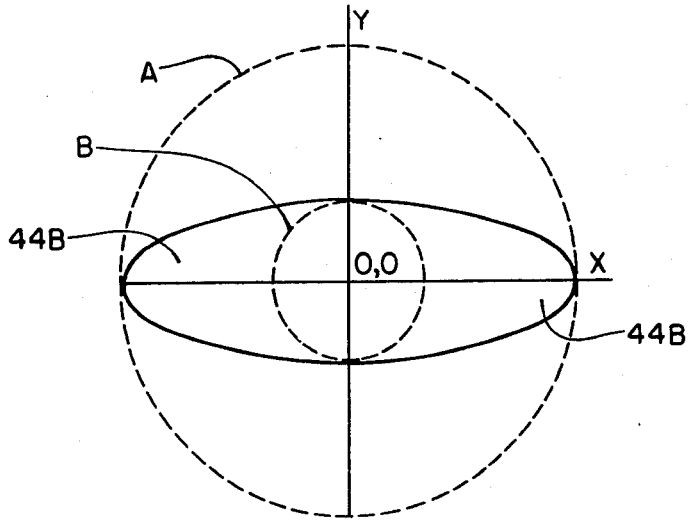
FIG. 5A
FIG. 5
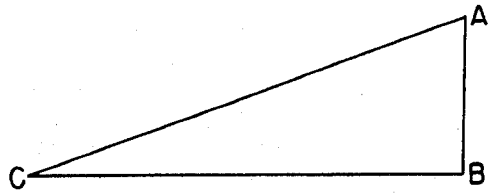
FIG. 5B
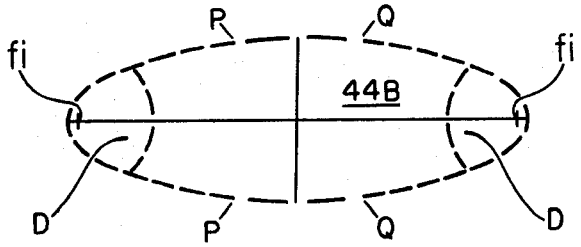
FIG. 5C

COMBINATION CARTON AND SHIPPING PACKAGE, DISPENSING SYSTEM THEREFOR

BACKGROUND OF THE INVENTION

The present invention relates generally to novel package systems and particularly to a combination hand carried dispensing and unitary carton-shipping package system for industrial size wipers.

At one time, virtually all industrial and shop wipers were assorted, odd-sized rags, sold typically in 25 pound bundles. Oftimes, there 25 pound bundles contained poor quality rags having a variety of fluid absorbent characteristics which did not adequately meet users needs.

In an effort to provide an effective replacement for rags and other textile products, which would meet most of the needs of the users, many manufacturers of paper and synthetic products developed large size sheets of absorbent paper and synthetic material for use as wipers and towels which could be packaged and rapidly dispensed, providing the user a better wiper product than the aforementioned textile wipers.

Some manufacturers have provided large size disposable wipers e.g. 18×15 inches packaged in bundles of 50 wipers or in cartons of up to 200 wipers. The wiper material has been produced having qualities which complete with the strength, bulk, durability and oil as well as water absorbency of textile products.

In preparing textile replacement products, manufacturers explored various techniques and methods for packaging their products. Some manufacturers prepared material in roll form for use in dispensers having a serrated cutter for cutting strips from the roll. Others packaged stacks of wipers in flat or folded sheet form, in bands or cartons for distribution from dispensers. Still others formed continuous unitary tissue strips folded across its width dimensions; each fold being in the alternate direction providing a zip-zag configuration containing perforations placed across its width dimension, at sequentially chosen locations, forming wiper segment regions. This folded and perforated strip is placed in a storage box. U.S. Pat. No. 3,490,645 dated Jan. 20, 1970 of James Glass et al describes such a tissue strip. Removal and separation of the tissue strips into wiper segments is accomplished by pulling a wiper strip out of the storage box through an opening therein and thereafter detaching each individual segment from the strip along the perforations. To provide compact storage of the wiper strips, the material is usually folded longitudinally into C-folds or Z-folds.

Realizing problems such as the inconvenience of physically detaching each wiper along the perforations from wiper strips, a search for various other means to effect wiper dispensing was initiated. This search resulted in the improved product of the present invention.

BRIEF SUMMARY OF THE INVENTION

The present invention is concerned with methods and apparatus for dispensing a plurality of serially connected folded wipers stacked in a tall carton, a tall carton being one having a height greater than the width of the widest segment of the folded wipers.

According to one aspect of the invention there is provided a dispensing system for dispensing wipers from a dispensing carton, the system having a substantially continuous web of wiper material, of a predetermined length having disposed therein a plurality of transverse perforation lines disposed substantially equidistant to form a plurality of serially connected separable wipers within the web, each of the perforated lines including a plurality of perforated teeth and slits disposed in a particular sequence, at least one of the first and last slits in each perforation line extending to a side edge of the web, the separable wipers being disposed in a stack in the carton. A dispensing port means is disposed in the carton for providing a port having a shape which permits detaching a leading separable wiper from the stack to yield a dispensed wiper. Detachment of the leading wiper from the trailing wiper is initiated by at least one of the first and last slots along the perforation line between the leading wiper and a trailing wiper straddling an edge of the port means. Following dispensing of the wiper, partial dispensing of the trailing separable wiper is effected so that dispensing and partial dispensing permits sequential dispensing of the stack of separable wipers. This system provides for dispensing of wipers in several formats such as W-fold and modified W-fold, the modified W-fold having the first and last folded segments approximately half the width of the plurality of intermediate folded segments.

According to another aspect of the present invention there is provided a method of making a zig-zag folded wiper dispensing system for dispensing wipers from a tall carton wherein the carton height exceeds the width of folded wiper segment.

BRIEF DESCRIPTION OF THE DRAWINGS

Referring to the drawing figures, in which like numerals represent like parts in the several views:

FIG. 5 is comprised of several plan view geometric diagrams at a reduced scale, namely FIGS. 5A–5C illustrating various parameters of the elliptically shaped dispensing port of the present invention;

DETAILED DESCRIPTION OF THE PREFERRED EMBODIMENT

Figure 1:
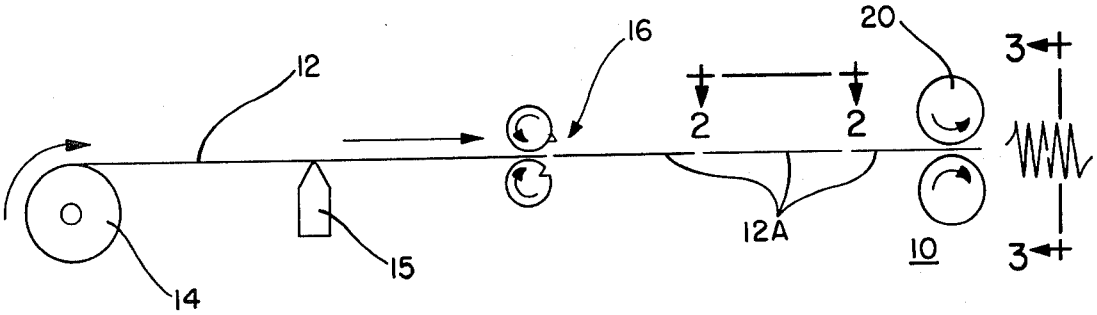
FIG. 1 is a block diagram of machinery used to form the web having a plurality of separable wipers of this invention.

Referring to the drawing figures, there is shown in FIG. 1 a block diagram 10 which is illustrative of machinery used to prepare a stack of separable wipers suitable for use in this invention.

A continuous and bulky web 12, illustratively, of four-ply creped wadding material having a thickness of approximately 508 micrometers (20 mils), a width of 38.10 cm (15 inches) and a length of at least 48.58 meters (1912.5 inches) is stored on storage reel 14. Web 12, which is fed from reel 14 into a conventional perforating device 16 is perforated in a chosen manner to provide a plurality of transverse perforation line 18—18 spaced equidistant along and transverse to the machine direction of web 12. (See FIG. 2.) Prior to the perforation operation, a plurality of equidistant lines are marked transverse to the direction of web travel, illustratively every 48.58 meters (1912.5 inches) by a marking device 15 so as to provide an indication of enough footage of web material 12A for forming a stack of separable wipers.

Figure 2:
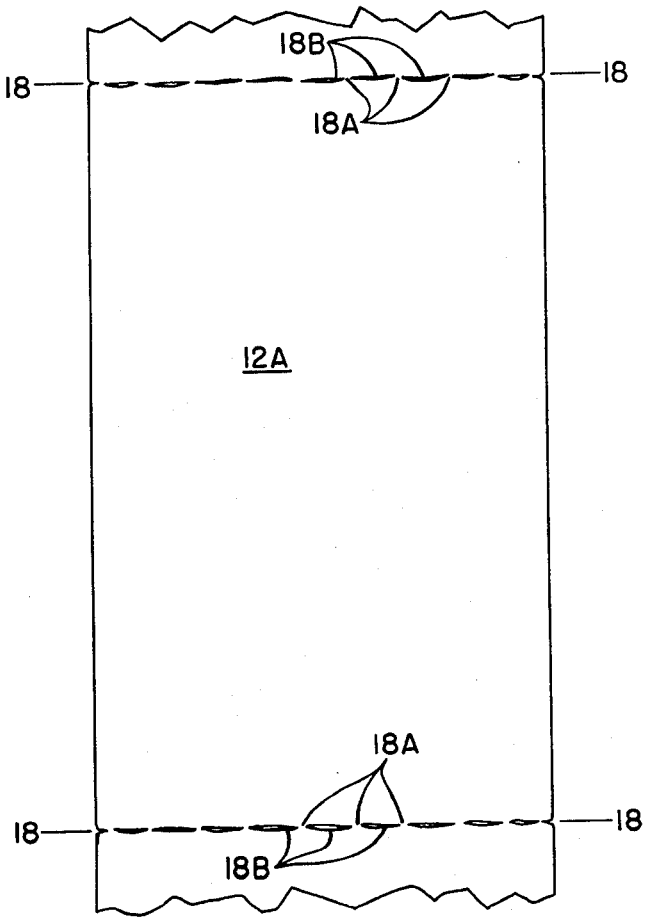
FIGS. 2 and 3 are cross sectional view of FIG. 1 along lines 2—2 and 3—3 respectively.

In FIG. 2, there is shown, as an elementary plan view of web 12A with lines 18—18 spaced at a chosen interval transverse to the machine direction or longitudinal axis of the web. Illustratively, lines 18—18 are nominally spaced every 64.77 cm (25½ inches). Also, each line 18 is comprised of a select number of perforation bonds or teeth 18A—18A are perforated slits 18B—18B of a certain width and length respectively, disposed in a particular manner. Illustratively, line 18 comprises in the preferred embodiment nine (9) teeth which are 203 micrometers (8.0 mils) width and eight (8) slits which are 4.445 cm (1¾ inches) long the slit length being approximately 220 times the tooth width; the two teeth at the extremities of line 18 are positioned inwardly from the edges of the web by approximately 1.27 cm (½ inch) leaving slits of approximately 1.27 cms (½ inch) extending to the edges. These perforating teeth and slits are capable of being served or broken in a controlled manner by means disclosed by this invention.

Figure 3:
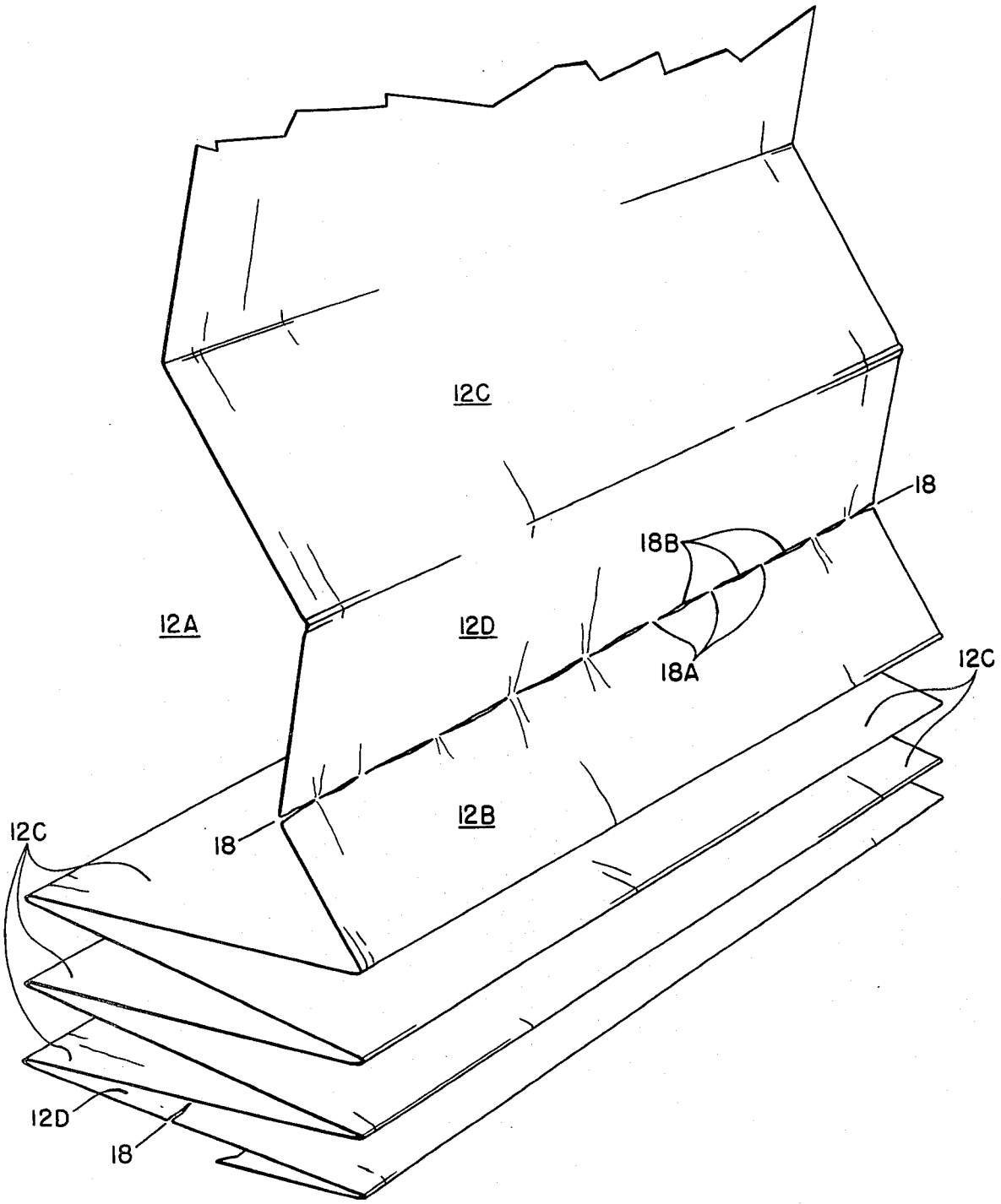

Each marked and perforated web 12A is fed into a conventional web folding device 20 which is capable of folding the web into a plurality of individually folded separable wipers, each separable wiper being folded in alternating opposite directions to form a stack of separable wipers as illustrated in FIG. 3. In the preferred embodiment each separable wiper is folded into 10.8×38.10 cm (4¼×15 inches) units within the substantially continuous web 12A, the perforation lines 18—18 preventing the web from being a totally continuous web. Illustratively, each separable wiper is comprised of a first half-size segment 12D. Each group of 75 folded but separable wipers in web 12A are manually detached along the marked line previously mentioned to form the stack of separable wipers that is placed in each of the storage compartments of the carton and shipping package of this invention.

Figure 4:
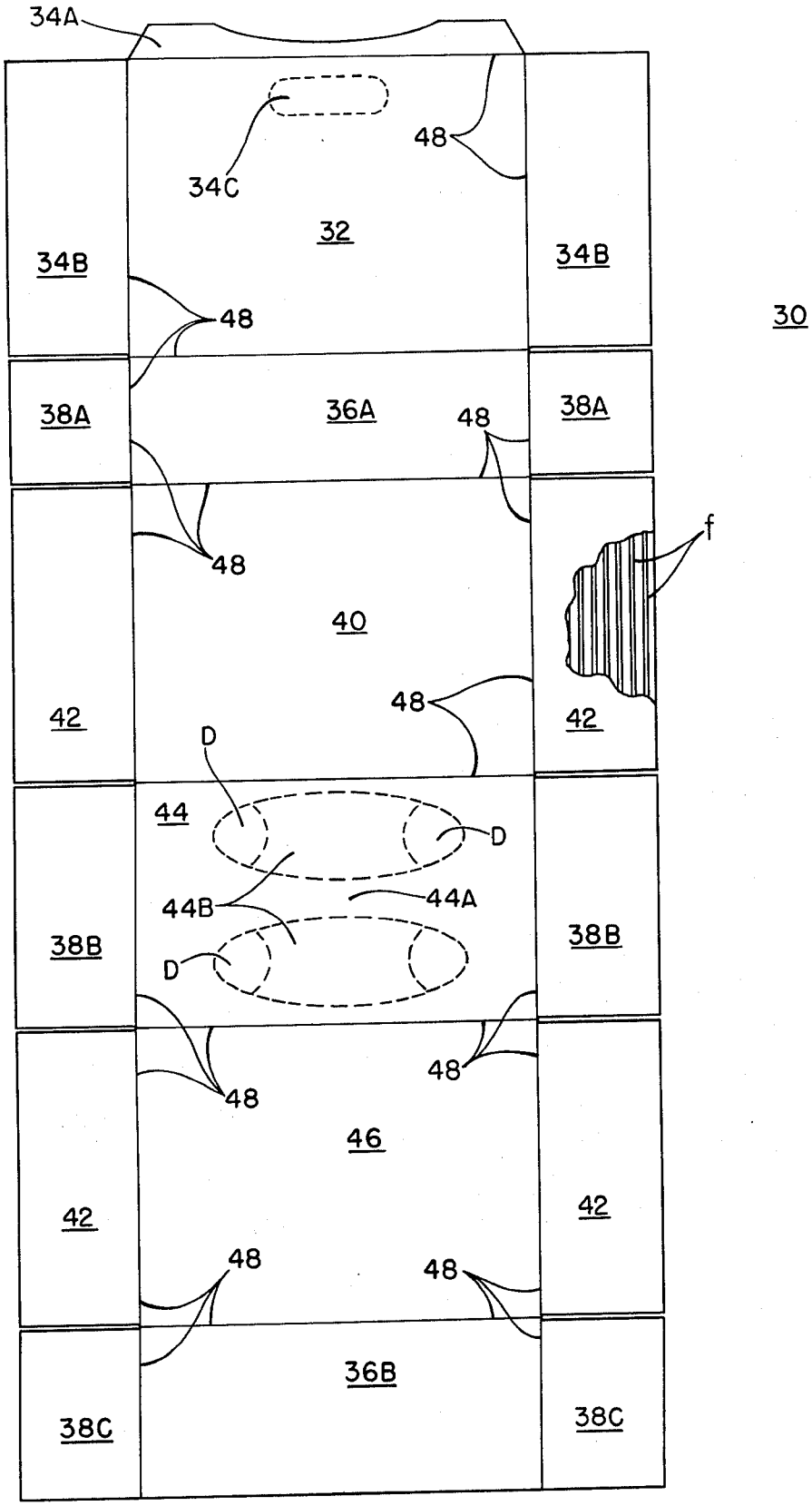
FIG. 4 is a plan view of a blank of box material utilized in this invention.

Means are provided in the carton and shipping package of this invention for dispensing individual wipers serially from the stack of separable wipers stored in the package. Referring now to FIG. 4, there is shown the organization of a blank 30 of box material used in constructing the carton and shipping package of this invention. In the preferred embodiment, blank 30, fabricated from a die-cut blank of corrugated single-wall (or sometimes referred to as double-faced) box board, or other case-forming material, cut to a predetermined thickness, size, direction and contour, having proper bending qualities is employed. Illustratively, blank 30 has a nominal thickness of 0.318 cms (0.125 inch) and a nominal basis weight of 52.6 kg (116 pounds) per 6500 $cm^2$ (1,000 square feet). The direction of the die-cut is such that flutes (f) of the corrugated fiberboard run parallel to the depth of the box, the side flutes being a B-flute construction of approximately 45 to 52 flutes per lineal foot. Blank 30 comprises a partition panel 32 with a 3.46 cm (1⅜ inches) wide partition tab 34A attached to a first end of the panel 32 and a pair of partition flaps 34B—34B attached to opposing ends. Panel 32 also has a perforated region 34C which when removed forms an aperture through which the fingers of a hand may be extended; a first bottom panel 36A with first partial inside flaps 38A—38A attached to opposing ends; a first side panel 40 with a pair of outside flaps 42—42 attached to opposing ends of panel 40; and a top panel 44 with full inside flaps 38B—38B attached to opposing ends, a second side panel 46 with a pair of outside flaps 42 attached to opposing ends and a second bottom panel 36B with a pair of second partial inside flaps 38C—38C attached to opposing ends.

Figure 7:
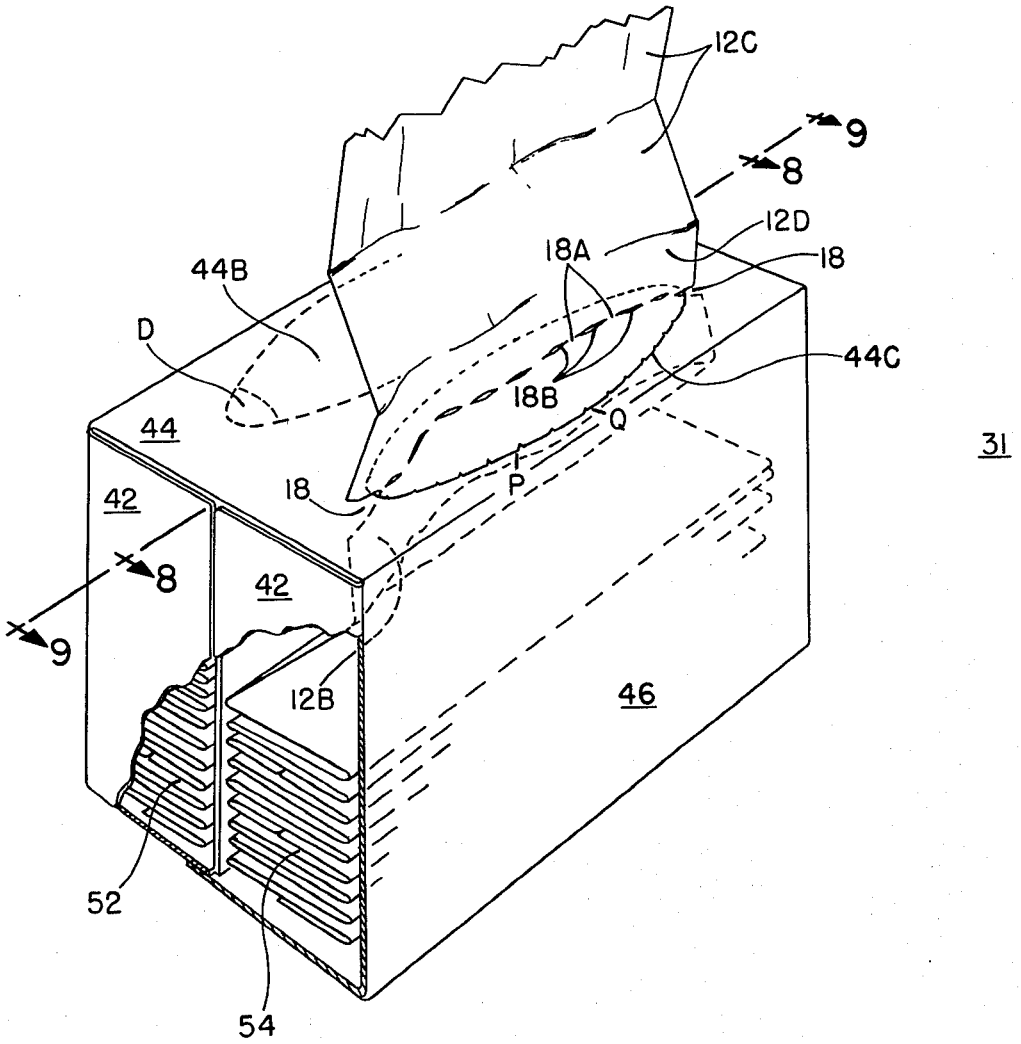
FIG. 7 is a fragmentary view of the separable wiper web of FIG. 2 illustrated in the dispensing position being dispensed from a carton, the carton shown as a cutaway perspective view.

Panel 44 also includes two elongated elliptically shaped perforated regions 44B—44B, which when removed, form two side-by-side dispenser ports 44C—44C (best seen in FIG. 7). Dispenser ports 44C—44C are used when dispensing the wipers from the stacks of wipers stored in the storage compartments of the package and are used in combination to form a hand opening for grasping a handle panel 44A used for hand carrying an open package.

Pursuant to a desirable feature of the invention, the size and shape of regions 44B—44B are related to the width of web 12 and to the size of hand of an average man. As illustrated in FIG. 5 and its sub-figures 5A–5C, the length or major axis and width or minor axis of region 44B are dictated by the diameter of the major and minor auxiliary circles, respectively, of the ellipse which defines regions 44B—44B, centered at X=0, Y=0 of the rectangular coordinates shown in FIG. 5A. Other elongated shapes may be used, however, but the elliptical shaped region has been chosen for use in the preferred embodiment. The auxiliary circles are used as an aid in forming the ellipse. The length of the major axis of the ellipse which corresponds to the diameter of the major auxiliary circle is so chosen to be shorter than the width of wiper 12A so that when a lead wiper is dispensed through port 44C a trailing wiper is partially pulled through port 44C and held about the circumference of port 44C by the retention forces caused basically by the length of the opening being substantially less than the width of the trailing wiper. This retention and holding action of the trailing wiper makes possible the "pop-out" feature of this dispensing system.

The length of the minor axis of the ellipse which corresponds to the diameter of the minor auxiliary circle is chosen to be substantially equivalent to the thickness of a fully-open hand of the average man so that the average man may be able to insert his hand through port 44C to grasp a wiper on the top of the stack of wipers. For representative dimensions for forming the preferred embodiment, the major auxiliary circle of the ellipse is 22.86 cm (9 inches) in diameter and the minor auxiliary circle is 7.62 cm (3 inches) in diameter.

To form the ellipse having major and minor axes corresponding to the diameters of the major and minor auxiliary circles respectively, several well-known methods may be used, such as obtaining a preformed template of the precise size or using analytical geometry or other plotting techniques to plot arcs and points which may be connected to form the shape.

Knowing the diameters of the major and minor auxiliary circles, represented by lengths AC and AB respectively, in FIG. 5B the coordinates of the foci can be determined. By using the well-known pythagorean theorem, which states the square of the hypotenuse of a right triangle equals the sum of the squares on the other sides, the length of CB which represents the distance between the foci fi-fi of FIG. 5C of the ellipse may be calculated. The coordinates of the foci along the major axis will be CB/2.

Having the coordinates of the foci and knowing that elliptical curves are characterized by the fact that the sum of the distances from any point on the curve to the two foci is constant for that particular ellipse, the shape of the ellipse having the chosen major and minor axes may be accurately traced by any of the aforementioned methods and disposed on top panel 44.

The perforated regions 44B—44B are comprised of two different sizes of perforation teeth and perforated slits, the slits being located between the teeth as illustrated in FIG. 5C at a reduced scale. The smaller of the two sets of perforation teeth and slits disposed along the arcs PP and QQ provide lines of weakness for initiating removal of the regions 44B—44B as well as to lessen the tendency of tearing the outer facing covering the horizontal flutes or corrugations during completion of the removal operation. The larger teeth and slits are disposed along arcs PQ—PQ in order to minimize the loss of board strength of top panel 44 due to the perforations as well as to lessen the tendency of tearing the outer facing covering the horizontal flutes or corrugations during removal of regions 44B—44B. Both the small and large teeth are spaced substantially equidistant along the arcs of the ellipse. Representative dimensions used to form the preferred embodiment provides six (6) teeth along arcs PQ—PQ having widths of 0.397 cm (5/32 inch) and the remaining twenty-four (24) teeth along arcs PP and QQ having widths of 0.318 cm ($\frac{1}{8}$ inch) with slits of 1.27 cm ($\frac{1}{2}$ inch in length) disposed equidistant between the teeth along the arcs. Additional perforations are disposed in regions D—D in a manner permitting easy access to region 44B—44B.

Score line 48—48 of FIG. 4 are disposed so as to facilitate folding the cardboard panels, the bending along the score lines being such that the fiberboard is not ruptured to a point where it seriously weakens the box.

Figure 6:
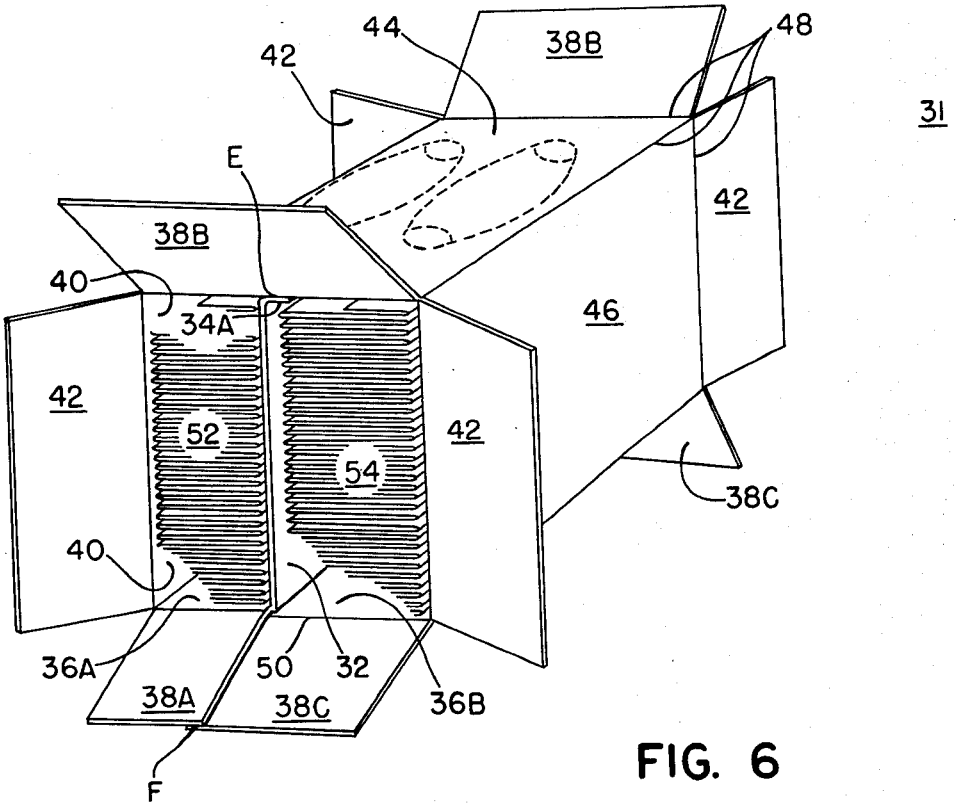
FIGS. 6 and 6A are perspective views of a preferred embodiment of the carton of this invention.
Figure 6A:
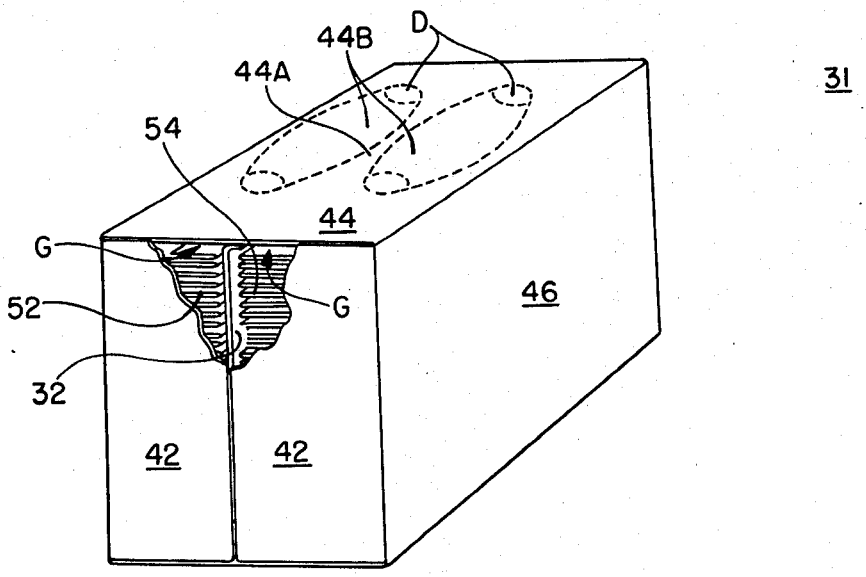

Referring now to FIG. 6, there is shown an open-end view of an assembled package 31 formed from the one-piece blank of board material and two stacks of separable wipers. To assemble package 31, blank 30 is folded along the designated score 48—48 starting with bending tab 34A and the first bottom panel 36A with partial inside flaps 38A—38A attached, in the direction shown to form partition 32. Then the first side panel 40 with outside flaps 42—42 attached, top panel 44 with the full inside flaps 38B—38B attached, second side panel 46 with outside flaps 42—42 attached and the second bottom panel 36B with partial inside flaps 38C—38C attached are folded in the direction shown to shape the blank into an open carton format. Each panel 34B—34B (not shown) are disposed to abut against a stack of separable wipers. Then partition tab 34A is cemented to a longitudinal region E of top panel 44 with a suitable glue in a manner disposing partition panel 32 to be equidistant from the two side panels 40 and 46, forming two adjacent wiper stack storage compartments 52 and 54 respectively. Following the act of forming the compartments, a free edge of second panel 36B is overlapped and abutted against a first edge region 50 of first bottom panel 36C and cemented to form a glued joint F which extends to the partial inside flaps which depend from the first and second bottom panels. The inside flaps 38A, 38B and 38C, illustratively are 90° rectangular panels, while outside flaps 42—42 are made to be substantially rectangular in shape but the outer edge corners of flaps 42—42 are oftimes slightly less than 90° corners to facilitate forming smooth ends upon closure of the package 30. Two stacks of wipers, illustratively 150 wiper units, 75 wipers per stack are end-loaded into respective storage compartments 52 and 54 and the flaps are closed and sealed with a conventional glue or in some instances with a conventional packaging adhesive tape forming the carton-package shown in FIG. 6A. The dispensing ports of package 31 is disposed at a height measured from the bottom of the carton which is approximately one half the length of a wiper which is dispensed from the carton.

The operation of the package system will now be discussed. This system provides a combination unitary shipping package and a wiper dispensing hand carrying carton, the carton having a built-in carrying handle and a unique "pop-out" dispensing feature that allows the trailing wiper from the wiper stack to be partially dispensed after the lead wiper is dispensed.

Upon sealing the flaps closed, package 31 becomes a shipping package suitable for cargo shipment in interstate or intrastate commerce. The aforementioned perforation teeth configuration in the top panel 44 associated with regions 44B—44B are disposed substantially in the same direction as the flutes of the board material and provide suitable strength to the facing to enable this package to be used as a shipping package. Upon removal of the elliptical shaped perforated regions 44B—44B, the shipping package becomes a wiper dispenser carton having a pair of dispensing ports members 44C—44C. These port members also provide an opening for grasping the handle panel member 44A disposed in top panel 44.

Figure 8:
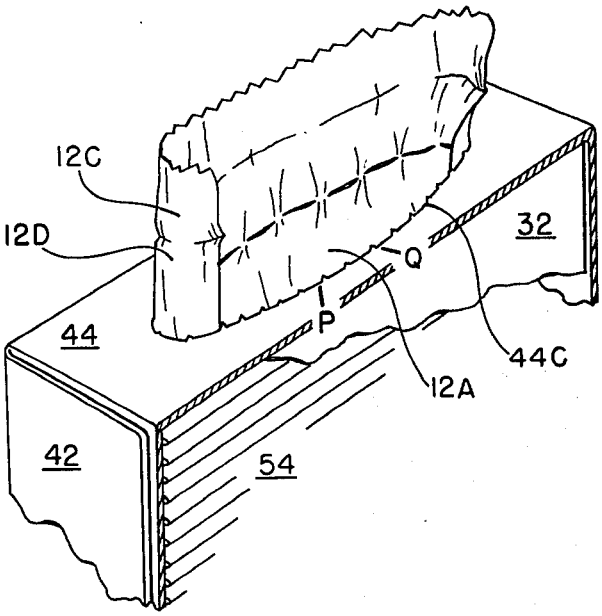
FIGS. 8 and 9 are cross-section views of FIG. 7 along lines 8—8 and 9—9.
Figure 9:
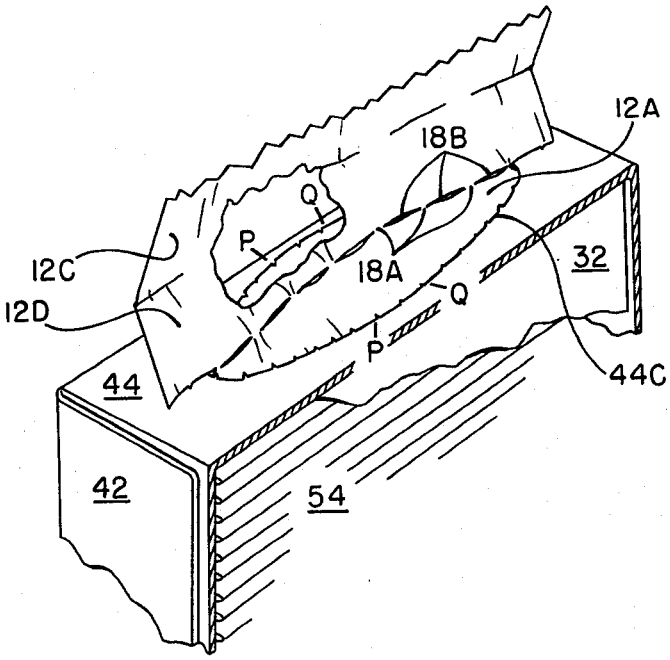

Since dispensing of wipers from either storage compartment is identical, only one storage compartment and one dispensing port will be referred to hereinafter to describe the manner in which wipers are dispensed. However, two storage compartments are used to provide stability to the package since a single stack of 75 separable wipers would tend to tumble over. Within the storage compartment the stack of separable wipers are of such a height and width that an initial air gap region G—G of approximately 0.635 cm ($\frac{1}{4}$ inch) exists between the first wiper in the stack and the top panel. Also, there is approximately a 0.635 cm ($\frac{1}{4}$ inch) clearance between the stack and the partition, sidewall and the side flaps which form the storage compartment. To dispense the first wiper from the stack of separable wipers the dispensing procedure requires the extraction of the wiper from the storage compartment and then a separation of it from the stack. The first half panel 12B (best seen in FIG. 2) is grasped and pulled so as to cause the remaining five (5) folded panels 12C—12C and the other half panel 12D to unfold and bend to an elongated convergent-shape (best seen in FIG. 7), as the panels pass through the dispensing port 44C of FIG. 7. As the first wiper is pulled further through port member 44C, the outer surface edge regions of panel 12D bend about a portion of the elongated convergent-shaped opening forming a somewhat distorted "C" shaped wiper. (See FIG. 8.) As the half panel 12D exists port member 44C, the outer surface edge regions of the lead wiper is released from the curl condition and the edges of the two wipers juxtaposed to the first and last slits straddle the substantially curved boundary regions of port 44C as shown in FIG. 9.

Figure 10:
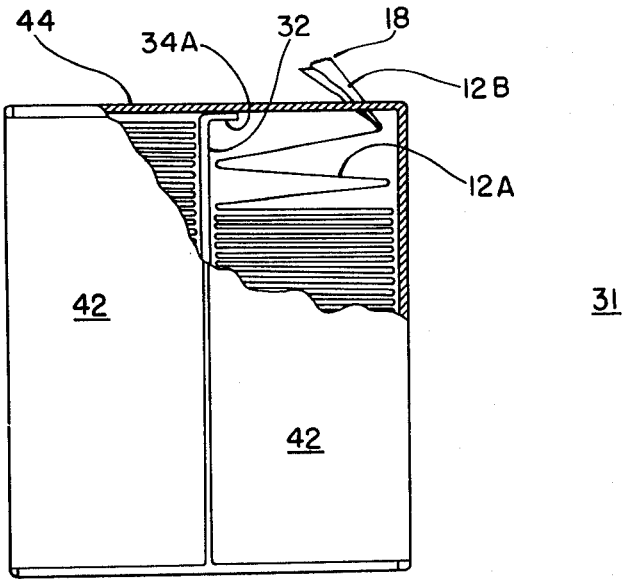
FIG. 10 is a plan view of the web and carton illustrative of the "pop-out" feature of this invention.

Also in this condition, the first and last perforation teeth of line 18 abut against the substantially curved boundary region of port member 44C. As further pulling force is exerted on the leading wiper, the first and last perforation teeth at the extremities of line 18 are severed automatically without being manually detached by a twisting action of the first half segment 12B of the trailing wiper which tends to twist in a direction opposite to that of the twisting action exerted on the other half segment 12D of the leading wiper. Once the outer extremity teeth are broken with the continuing pulling force being exerted on the leading wiper against the resistive forces being exerted on the trailing wiper by the bottom face of panel 44, the frictional force caused by the arc boundary regions PQ of port member 44C as the trailing wiper protrudes through port member 44C causes a force exceeding the tensile force to occur within the remaining interior perforation teeth which overcomes effectively the tensile force in the teeth resulting in a chain-type teeth breaking reaction across the transverse line 18 separating the leading wiper from the trailing wiper. Upon separation, the first half segment of the trailing wiper is held within the boundaries of the oval opening; the full segment of the wiper becomes partially unfolded to form expended zig-zag segments which are weakly indispensibly displaced from the hard fold format. These full segments extend from the port to the top of the stack of separable wipers in a manner which tends to resist fall back of the trailing wiper onto the stack, see FIG. 10.

If the first and last teeth had been disposed at the extremities of the transverse line 18, this aforementioned separation sequence would probably not occur since the outer edges of the trailing wiper unit would not have been given a chance to abut against the bottom face of top panel 44 of the package. Also, if the teeth 11A—11A along line 18 are not sized and spaced to present minimal resistance to breakage, the chain-type teeth breaking reaction would be hindered, thus preventing the leading wiper from being separated from the stack of wipers.

Other fold configurations of separable wipers such as "V", "C" and "Z" fold zig-zag may be used in this invention provided the perforation teeth and slits are spaced in the manner specified supra.

In the preferred embodiment as previously noted, the four-ply creped wadding web was specified in order to provide high strength and good oil and water absorbency characteristics in the wiper. However, the web could be other materials such as nylon scrim reinforced tissue laminate or absorbent polyolefin of a thickness which can be perforated, folded in the alternating opposite directions and which can be separated in the manner as delineated by the present invention.

Also, the shape of the dispensing port may be varied to form similar shaped openings such as diamond and rectangular forms, provided the dispensing of the leading separable wiper and the popping out of the carton of the trailing wiper, as disclosed, can be accomplished.

It is understood that the above described embodiments are mainly illustrative of the principles of the invention. One skilled in the art may make changes and modifications to the embodiments disclosed herein and may devise other embodiments without departing from the scope and essential characteristics thereof.

What is claimed is:

1. A dispensing system for dispensing folded wipers from a tall dispensing carton, said wipers being folded into segments in a chosen manner, said tall carton having a height greater than the length of the transverse fold of the widest segment of said folded wipers, said system comprising:

(a) a substantially continuous web of wiper material of a predetermined length having disposed therein a plurality of transverse perforation lines disposed substantially equidistant to form a plurality of serially connected separable wipers within said web, each of said perforation lines comprising a plurality of perforation teeth and slits disposed substantially equidistant, the slit length being approximately 220 times the tooth width, at least one of the first slit and last slit in each perforation line extending to a side edge of said web, each of said separable wipers being hard-folded into lengthwise segments in alternating opposite directions to form a plurality of folded segments of a given format and disposed in a vertical stack on said carton; and (b) a dispensing port means disposed in a top panel of said carton for providing a centrally disposed port having an oval shape which permits detaching a leading separable wiper from said stack to yield a dispensed wiper, the detachment of said leading wiper being initiated at one of said first and last slits along the perforation line between said leading and trailing wiper straddling said side edges of said oval port, and following dispensing of said lead wiper for effecting partial dispensing of said trailing wiper, said trailing wiper entering said oval port immediately after detachment of said lead wiper, said trailing wiper being retained within the boundaries of said oval opening by said side edges in a manner opposing fallback of said trailing wiper onto said stack of wipers, said dispensing being performed without the need for mechanical assistance.

2. Apparatus in accordance with claim 1 wherein said perforation teeth on said web are spaced substantially equidistant along each of said perforation lines so that a first and last perforation slit extends to the edges of said web, said first and last slits having a length approximately half the length of said slit length that extends between each of said perforation teeth.

3. Apparatus in accordance with claim 2 wherein the format of the folded segments of said separable wipers provide a first and a last segment transversely folded to approximately half the length of a plurality of intermediate folded segment.

4. Apparatus in accordance with claim 1 wherein said dispensing means includes a perforated region of a substantially oval shape within a top panel of said dispensing carton providing lines of weakness in said top panel; said lines of weakness permitting removal of said perforated region forming a dispensing port having an opening of the shape of said perforation region, where said port providing a passageway for extracting a wiper from the stack of separable wipers stored in said carton.

5. Apparatus in accordance with claim 4 wherein when said leading separable wiper is pulled through said port it is detached from said trailing separable wiper along the perforation line disposed between said leading and trailing separable wiper, the detachment being initiated by the outer edges of the first half segment of said trailing separable wiper containing said first and last perforation slits as said edges butt against the facing on the bottom surface of said top panel;

wherein the outer edges of the last half segment of said leading separable wiper is caused to curl in a first direction towards the center of the web while the outer edges of the first half segment of said trailing wiper is caused to curl in a second opposite direction towards the center of the web as the leading separable wiper is being pulled through said port, wherein the first and second opposite directed curling actions of said leading and trailing separable wipers produce a twisting motion upon each of said teeth, the slit length being approximately 220 times the tooth width, causing the shearing of said teeth effecting positive detachment of said leading separable wiper; and wherein after the detachment of said leading separable wiper, the first half segment of the trailing wiper is disposed partially out of said port ready to be grasped by the user.

6. Apparatus in accordance with claim 3 wherein said dispensing means includes a perforated region of a substantially oval shape within a top panel of said dispensing carton providing lines of weakness in said top panel; said lines of weakness permitting removal of said perforated region forming a dispensing port having an opening of the shape of said perforation region, said port providing a passageway for extracting a wiper from the stack of separable wipers stored in said carton.

7. Apparatus in accordance with claim 6 wherein said leading separable wiper being pulled through said port is detached from said trailing separable wiper along the perforation line disposed between said leading and trailing separable wipers, the detachment being initiated by the outer edges of the first half segment of said trailing separable wiper containing said first and last perforation slits as said edges butt against the facing on the bottom surface of said top panel;

wherein the outer edges of the last half segment of said leading separable wiper is caused to curl in a first direction towards the center of the web while the outer edges of the first half segment of said trailing wiper is caused to curl in a second opposite direction twoards the center of the web as the leading separable wiper is being pulled through said port, wherein the first and second oppositely directed curling actions of said leading and trailing separable wipers produce a twisting motion upon each of said teeth, the slit length being approximately 220 times the tooth width, causing the shearing of said teeth effecting positive detachment of said leading separable wiper; and wherein after the detachment of said leading separable wiper, the first half segment of the trailing wiper is disposed partially out of said port ready to be grasped by the user.

8. Apparatus in accordance with claim 7 wherein the chosen shape of said perforation region in said top panel is an ellipse, wherein the major auxiliary circle of the ellipse has a diameter equal to the length of said port and having a minor auxiliary circle of said ellipse with a diameter that is relatively smaller than the diameter of said major auxiliary circle and wherein said port has a length approximately three-fourths the width of said web.

9. Apparatus in accordance with claim 5 wherein the chosen shape of said perforation region in said top panel is an ellipse, wherein the major auxiliary circle of the ellipse has a diameter equal to the length of said port and having a minor auxiliary circle of said ellipse with a diameter that is relatively smaller than the diameter of said major auxiliary circle and wherein said port has a length approximately three-fourths the width of said web.

10. Apparatus in accordance with claim 8 or 9 wherein the first half segment of said trailing separable wiper is held within the boundary of the elongated shaped port, said intermediate full segments of said trailing separable wiper being partially unfolded to form expanded alternating opposite directed segments which are weakly, inextensibly displaced from the hard fold format, said intermediate segments extending from the port to the top of the stack of separable wipers, said expanded segments of the trailing wiper being disposed in a manner which tends to resist fallback of the segments of the trailing separable wipers onto the stack.

11. Apparatus in accordance with claim 1 including a second dispensing carton disposed side-by-side and being separated by a partition panel, each package having a stack of separable wipers stored therein, said second carton being used to balance said storage compartment by opposing the tendency of said storage compartment from tumbling over during shipment as well as when fully packed with the stack of the separable wipers, said second storage compartment providing stability to the package.

12. Method of making a zig-zag folded wiper dispensing system for dispensing wipers from a carton having a height greater than the length of the transverse fold of the widest folded segment of said zig-zag folded wipers, comprising the steps of:

(a) transversely perforating a plurality of perforation lines spaced equidistant along a predetermined length of wiper material web to form a predetermined number of serially connected separable wipers, the perforation lines providing the separability characteristic to the web, each perforation line being comprised of a predetermined number of perforation teeth and slits spaced equidistant along the line with at least one of the first and last slits extending to the respective edges of the web;

(b) transversely folding each of said separable wipers in said web in alternating opposite directions such that folded segments are formed;

(c) forming a carton for housing said folded web, said web being disposed in said carton such that each separable wiper is stacked upon the next in a column, said carton having a height approximately one-half the length of an unfolded wiper; and (d) forming a removal elongated region in a top panel of said carton of a given shape, the region which when removed, providing a dispensing port having an opening along a major axis of said top panel for the stack of separable wipers having a length dimension shorter than the width of said web;

whereby the dispensing port may be formed by removing said removal region of said carton;

wherein when said leading separable wiper is pulled through said port it is detached from said trailing separable wiper along the perforation line disposed between said leading and trailing separable wiper, the detachment being initiated by the outer edges of the first half segment of said trailing separable wiper containing said first and last perforation slits as said edges butt against the facing on the bottom surface of said top panel; wherein the outer edges of the last half segment of said leading separable wiper is caused to curl in a first direction towards the center of the web while the outer edges of the first half segment of said trailing wiper is caused to curl in a second opposite direction towards the center of the web as the leading separable wiper is being pulled through said port, wherein the first and second oppositely directed curling actions of said leading and trailing separable wipers produce a twisting motion upon each of said teeth, the slit length being approximately 220 times the tooth width, causing the shearing of said teeth effecting positive detachment of said leading separable wiper; and wherein after the detachment of said leading separable wiper, the first half segment of the trailing wiper is disposed partially out of said port ready to be grasped by the user.

13. A method as defined in claim 12, including the step of adding an identical second carton having a stack of separable wipers stored therein in juxtaposed relationship, said second carton being used to balance said storage compartment by opposing the tendency of said storage compartment from tumbling over during shipment and when fully packed with the stack of separable wipers, said second storage compartment providing stability to the package.

14. A method as defined in claim 12, wherein said removal region of each carton has an oval shape, wherein said oval shape is an ellipse, having a major axis approximately one-third the length of said major axis.

15. A method as defined in claim 12 or 13, wherein said carton is formed to a height approximately one-half the length of an unfolded wiper.

* * * * *

UNITED STATES PATENT AND TRADEMARK OFFICE

CERTIFICATE OF CORRECTION

PATENT NO. : 4,469,243

DATED : Sep. 4, 1984

INVENTOR(S) : Ito et al.

It is certified that error appears in the above-identified patent and that said Letters Patent are hereby corrected as shown below:

Column 1, line 28, change "complete" to --compete--.

Column 3, line 16, change "are" to --and--.

Column 9, line 40, change "twoards" to --towards--.

Signed and Sealed this

*Twenty-third* Day of *April 1985*

[SEAL]

*Attest:*

DONALD J. QUIGG

*Attesting Officer*

*Acting Commissioner of Patents and Trademarks*